US009676024B2

(12) United States Patent
Wunderle et al.

(10) Patent No.: US 9,676,024 B2
(45) Date of Patent: Jun. 13, 2017

(54) CONVEYING DEVICE FOR MOLTEN METAL IN AN INJECTION DIE CASTING UNIT

(71) Applicant: GEBR. KRALLMANN GMBH, Hiddenhausen (DE)

(72) Inventors: Johannes Konrad Wunderle, Kenzingen (DE); Andreas Neuss, Worms (DE); Rainer Krallmann, Hiddenhausen (DE); Kerstin Krallmann, Bad Salzuflen (DE); Ingo Brexeler, Ruhr (DE)

(73) Assignee: GEBR. KRALLMANN GMBH, Hiddenhausen (DE)

( * ) Notice: Subject to any disclaimer, the term of this patent is extended or adjusted under 35 U.S.C. 154(b) by 259 days.

(21) Appl. No.: 14/405,525

(22) PCT Filed: May 31, 2013

(86) PCT No.: PCT/EP2013/001601
§ 371 (c)(1),
(2) Date: Dec. 4, 2014

(87) PCT Pub. No.: WO2013/182284
PCT Pub. Date: Dec. 12, 2013

(65) Prior Publication Data

US 2015/0151357 A1 Jun. 4, 2015

(30) Foreign Application Priority Data

Jun. 4, 2012 (DE) ..... 10 2012 010 923

(51) Int. Cl.
*B22D 41/00* (2006.01)
*B22D 17/20* (2006.01)
(Continued)

(52) U.S. Cl.
CPC ..... *B22D 17/203* (2013.01); *B22D 17/04* (2013.01); *B22D 17/2023* (2013.01);
(Continued)

(58) Field of Classification Search
CPC ..... B22D 17/04; B22D 17/2023
(Continued)

(56) References Cited

U.S. PATENT DOCUMENTS 5,205,338 A 4/1993 Shimmell
5,632,321 A 5/1997 Hegel et al.
(Continued)

FOREIGN PATENT DOCUMENTS

DE 692 22 510 T2 4/1998
DE 600 35 147 T2 2/2008
(Continued)

*Primary Examiner* — Scott Kastler
(74) *Attorney, Agent, or Firm* — McGlew and Tuttle, P.C.

(57) ABSTRACT

A conveying device for molten metal in an injection die casting unit, has a storage container for the molten metal and a conveying duct delivering the molten metal to a mold cavity. The conveying duct includes a cylinder bore with a piston disposed in an axially adjustable manner. A collection chamber, from which the molten metal is introduced through an onward line into the mold cavity upon axial displacement of the piston, is provided for the molten metal. An annular space, which is connected via at least one filling bore to the collection chamber, is formed between the outer wall of the piston and the inner wall of the cylinder bore. The filling bore, on an end which opens into the collection chamber, is closable by means of a valve body which is connected to an adjustable valve rod which is displaceably disposed in an axial bore of the piston.

13 Claims, 3 Drawing Sheets

(51) Int. Cl.

| | |
|---|---|
| ***B22D 17/28*** | (2006.01) |
| ***B22D 37/00*** | (2006.01) |
| ***B22D 17/04*** | (2006.01) |
| ***B22D 17/30*** | (2006.01) |

(52) U.S. Cl.
CPC ..... *B22D 17/2038* (2013.01); *B22D 17/28* (2013.01); *B22D 17/30* (2013.01); *B22D 37/00* (2013.01); *B22D 41/00* (2013.01)

(58) Field of Classification Search
USPC ..... 222/597
See application file for complete search history.

(56) References Cited

U.S. PATENT DOCUMENTS

| | | | | |
|---|---|---|---|---|
| 6,840,302 | B1 | 1/2005 | Tanaka et al. | |
| 7,163,046 | B2 | 1/2007 | Tanaka et al. | |
| 2003/0000676 | A1 | 1/2003 | Motegi et al. | |
| 2005/0006046 | A1 | 1/2005 | Tanaka et al. | |
| 2009/0178776 | A1 | 7/2009 | Minamimura et al. | |
| 2014/0042193 | A1 | 2/2014 | Aspacher et al. | |
| 2015/0151357 | A1* | 6/2015 | Wunderle ..... | B22D 17/203 222/597 |

FOREIGN PATENT DOCUMENTS

| | | | |
|---|---|---|---|
| DE | 10 2009 012 636 | A1 | 9/2010 |
| EP | 1 046 445 | B1 | 6/2007 |
| JP | 11254119 | A | 9/1999 |
| WO | 02/085560 | A1 | 10/2002 |
| WO | 2012/146408 | A1 | 11/2012 |

* cited by examiner

CONVEYING DEVICE FOR MOLTEN METAL IN AN INJECTION DIE CASTING UNIT

CROSS REFERENCE TO RELATED APPLICATIONS

This application is a United States National Phase Application of International Application PCT/EP2013/001601 filed May 31, 2013 and claims the benefit of priority under 35 U.S.C. §119 of German Patent Application DE 10 2012 010 923.7 filed Jun. 4, 2012, the entire contents of which are incorporated herein by reference.

FIELD OF THE INVENTION

The invention relates to a conveying device for molten metal in an injection die casting unit, for example a metal-casting machine, having a storage container for the molten metal and a conveying duct in which the molten metal is deliverable to a mold cavity, wherein the conveying duct comprises a cylinder bore in which a piston is disposed in an axially adjustable manner, and wherein a collection chamber for the molten metal, from which the molten metal is introducible through an onward line into the mold cavity as a result of an axial displacement of the piston, is provided.

BACKGROUND OF THE INVENTION

In the case of a metal-casting machine, molten metal, which is usually a metal alloy, is introduced into a mold cavity and hardens therein, such that a metal component which corresponds to the mold cavity is formed. Introduction of the molten metal may take place alone as a result of gravity, for example.

However, it has been demonstrated that this introduction of the molten metal into the mold cavity is comparatively slow, particularly in the case of components in which a metal portion is molded onto a basic body which is usually composed of plastic. The processing speed, i.e. the maximum number of operating cycles per unit of time, is thus greatly restricted in the case of the metal-casting machine.

From EP 1 046 445 B1 a conveying device of the generic type for molten metal, having a piston which is axially adjustable in a cylinder bore, is known. The molten metal, by means of a rotatingly driven screw conveyor which is perpendicularly disposed in relation to the piston, can be introduced via a lateral inlet bore into a collection chamber which is configured ahead of the piston in the cylinder bore, and by way of an axial displacement of the piston is then pressed into an onward conveying line and from there into a mold cavity. This construction is complex and requires a large installation space.

SUMMARY OF THE INVENTION

The invention is based on the object of providing a conveying device for molten metal in an injection die casting unit, for example a metal-casting machine, which possesses a simple, compact construction and by way of which the molten metal is introducible into a mold cavity at high cycle rates.

According to the invention, a conveying device is provided for molten metal in an injection die casting unit, having a storage container for the molten metal and a conveying duct in which the molten metal is deliverable to a mold cavity. The conveying duct comprises a cylinder bore in which a piston is disposed in an axially adjustable manner, and that a collection chamber for the molten metal, from which the molten metal is introducible through an onward line into the mold cavity as a result of the axial displacement of the piston, is configured. The collection chamber is preferably configured in the cylinder bore.

This proceeds according to the invention from the fundamental principle of providing a predetermined amount of the molten metal in the collection chamber and squeezing said molten metal out of said collection chamber by way of displacing the piston and conveying said molten metal via the onward line into the mold cavity. The piston subsequently returns to its initial position, whereby fresh molten metal may already flow into the collection chamber during the return movement of the piston. The movement of the piston is preferably conceived such that the collection chamber is already completely filled with replenishing molten metal flowing in when the piston has reached its upper initial position, so that said piston can again immediately carry out its displacement by way of which the molten metal is squeezed out of the collection chamber and through the onward line into the mold cavity.

The molten metal from the storage container is introducible via at least one filling bore into the collection chamber. While the piston moves back into its initial position, the molten metal runs through the filling bore, which is preferably configured in the piston and particularly preferably penetrates the piston, into the collection chamber which has simultaneously been vacated by the piston. It has been demonstrated that replenishment of the collection chamber can be achieved very rapidly and in a reliable manner in this way. Preferably, a plurality of filling bores which are arranged in parallel and thus ensure rapid filling of the collection chamber are provided.

During the return movement of the piston back to its initial position, the filling bore or the filling bores, respectively, is/are constantly connected to the storage container for the molten metal, on the one hand, and to the collection chamber, on the other. This is achieved according to the invention in that an annular space is formed in a predetermined portion of the piston between the outer wall of the piston and the inner wall of the cylinder bore, and in that the annular space is connected via the filling bore or the filling bores, respectively, to the collection chamber. In addition, the annular space is supplied with molten metal from the storage container.

In order to be able to control the delivery of molten metal into the collection chamber, it is provided according to the invention that the filling bore, on its end which opens into the collection chamber, is closable by means of a valve body. In the event that a plurality or filling bores arranged in parallel are provided, a common valve body may be provided therefor. The valve body can be adjusted between a closed position, in which it inhibits the flow of the molten metal from the filling bore into the collection chamber, and an open position, in which the molten metal can flow from the filling bore or the filling bores, respectively, into the collection chamber. For adjustment of the valve body, the latter is connected to an adjustable valve rod which is preferably provided with a drive which is actuated by a control device.

Here, the valve rod is displaceably disposed in an axial bore or in a longitudinal central bore of the piston, on account of which a very compact construction results. The valve body and the valve rod thus may be displaced together with the piston within the cylinder bore, and also be adjusted in relation to the piston.

Sealing between the piston and the cylinder bore is achieved in that the piston, at least in portions, sits having a tight fit in the cylinder bore.

The cross section of the valve body is preferably smaller than the cross section of the cylinder bore, such that the molten metal can freely flow around the valve body within the cylinder bore.

In order to avoid a return flow of the molten metal from the onward line into the collection chamber, it is provided in a refinement of the invention that a check valve, which may be a spring-loaded valve body, for example, is disposed in the onward line.

Further details and features of the invention are apparent from the following description of an exemplary embodiment, with reference to the drawing.

The present invention shall be explained in more detail on the basis of the following figures and exemplary embodiments, without the present invention being limited to these. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
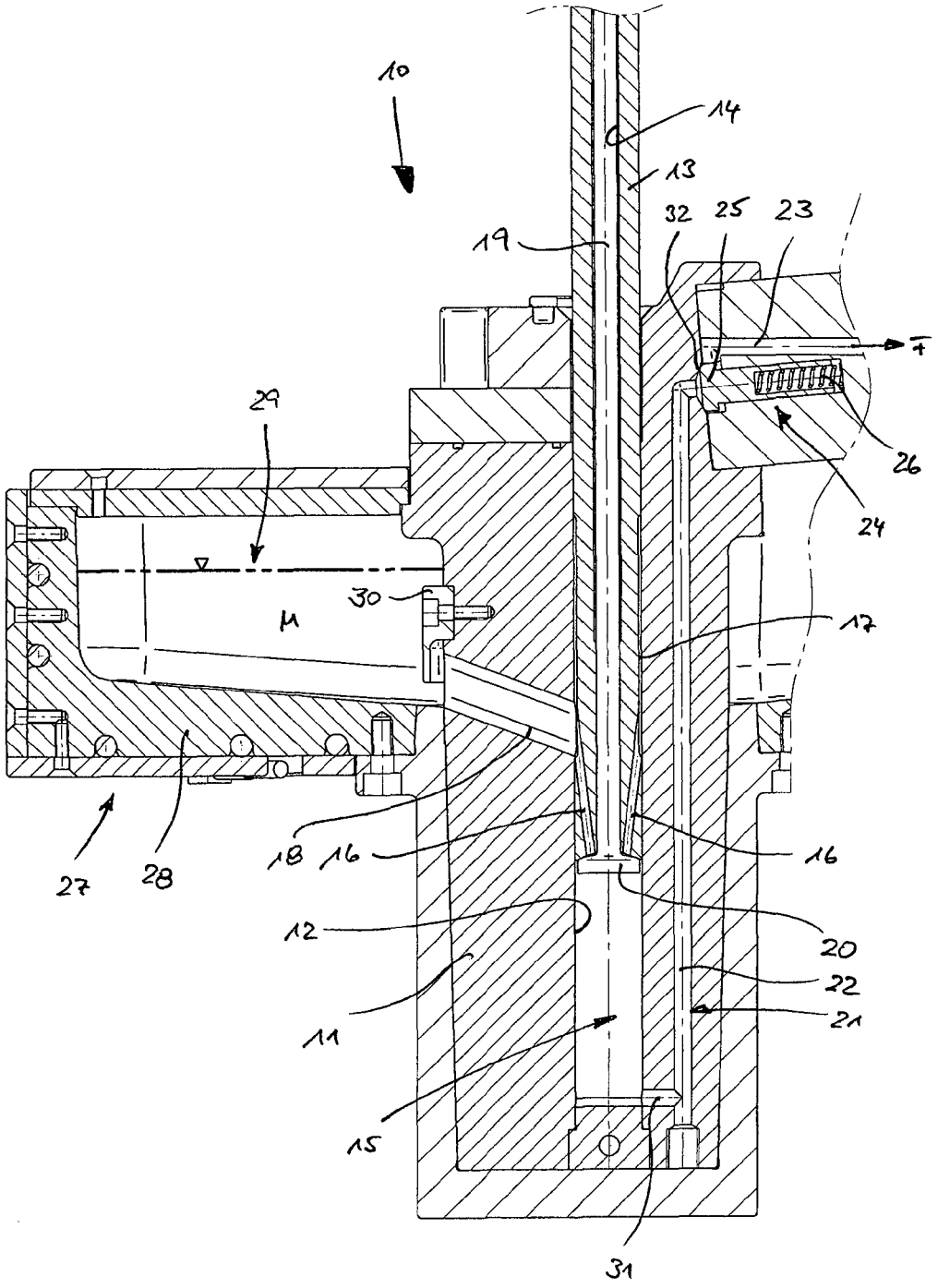
FIG. 1 is a longitudinal sectional view through a conveying device according to the invention.

A conveying device 10 illustrated in FIG. 1 possesses a housing 11 in which a vertical cylinder bore 12 is configured.

A storage container 27 for molten metal M is placed onto the housing 11, said storage container 27 comprising a container housing 28 in which a container interior space 29 which is filled with the molten metal M is configured. The molten metal M may be delivered to the container interior space 29 in liquid form, or be produced therein by melting a metallic granulate, for example.

The container interior space 29 of the storage container 27 is connected via at least one supply duct 18, which runs obliquely downward and is inclined in the direction of flow, to the cylinder bore 12. A slag separator 30, which has the effect of a filter, is provided in the container interior space 29, at the inlet of the supply duct 18.

A piston 13 is displaceably inserted with a tight fit into the cylinder bore 12. In a region which is disposed in the lower half of the axial length of the piston 13 but which has an axial spacing from the lower end of the piston 13, an annular space 17 is configured on the outer surface of the piston 13. A plurality of filling bores 16 which are disposed so as to be distributed over the circumference of the piston 13 run on the lower end of the annular space 17, in each case toward the lower end face of the piston 13 (see FIG. 2). That region of the piston 13 in which the filling bores 16 are configured bears in a sealed manner on the inner wall of the cylinder bore 12.

The piston 13 furthermore displays a centric axial bore 14 in which a valve rod 19 which completely penetrates the piston 13 and, on its lower end downstream of the end side of the piston 13, carries a plate-type valve body 20 is disposed in a displaceable manner. The valve body 20, by displacing the valve rod 19 in relation to the piston 13, can be adjusted between a closed position illustrated in FIG. 2, in which the valve body 20 prevents an outflow of molten metal from the filling bores 16, and an open position illustrated in FIG. 3, in which the molten metal can flow from the filling bores 16 into a collection chamber 15, lying therebelow, which is formed in the cylinder bore 12.

Figure 2:
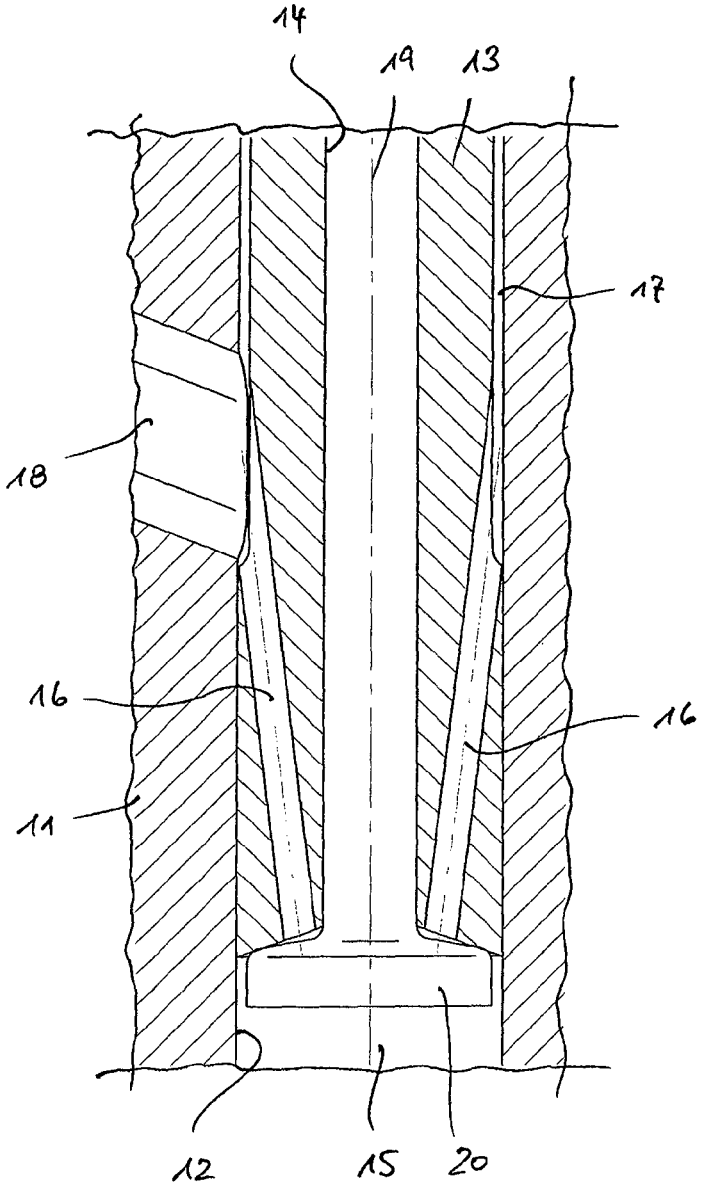
FIG. 2 is an enlarged sectional illustration of the lower end of the piston, with the valve body in the closed position.
Figure 3:
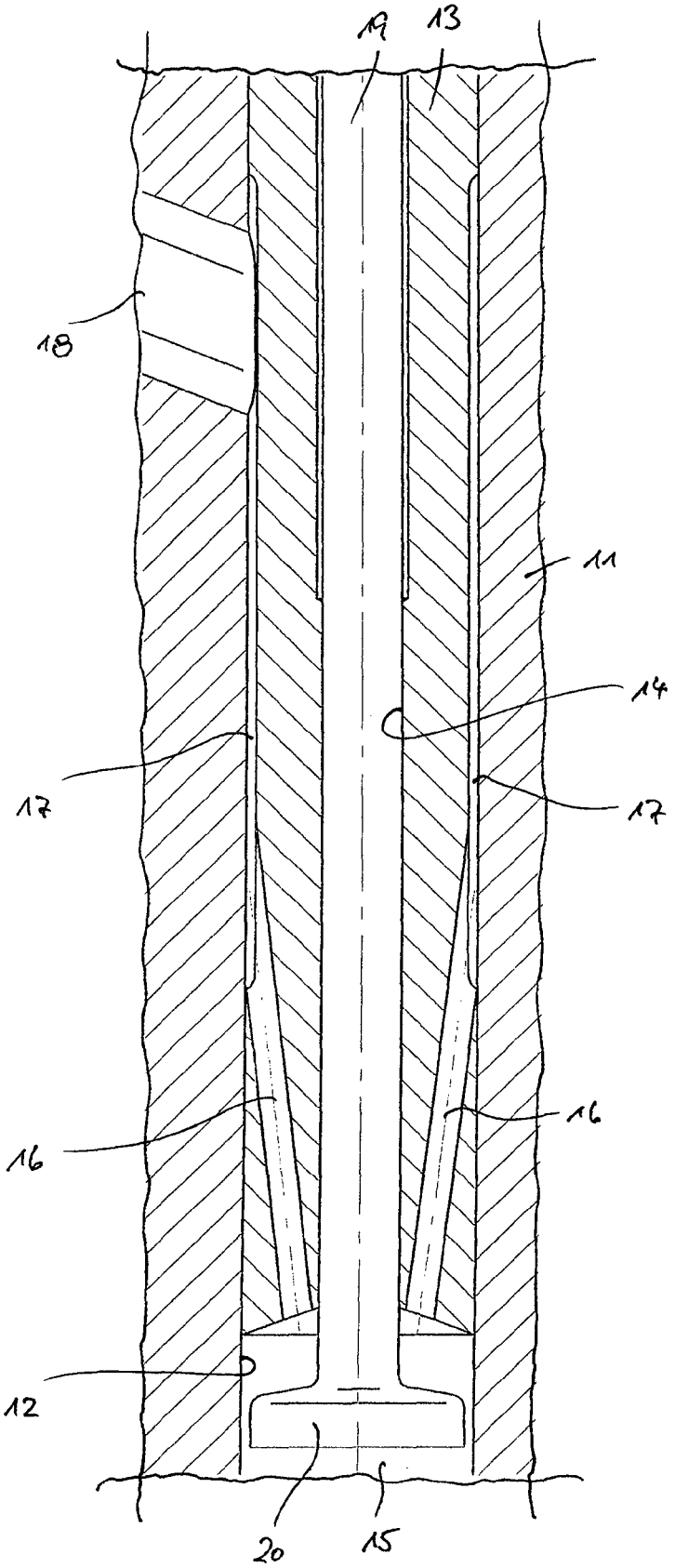
FIG. 3 is an enlarged sectional illustration showing the piston in its lower position, with the valve body in the open position.

As is shown by FIGS. 2 and 3, the cross section of the valve body 20 is smaller than the cross section of the cylinder bore 12, such that the valve body 20 has no sealing function within the cylinder bore 12 and the molten metal M can freely flow around the valve body 20.

The cylinder bore 12 or the collection chamber 15 formed therein, respectively, on the lower end is connected via an onward line 21 to a mold cavity F which is not illustrated in more detail. The onward line 21 comprises a lower transverse bore 31 via which the collection chamber 15 is connected to a vertical riser 22. The riser 22, at its upper end, transitions into a substantially horizontally running filling duct 23 from which the molten metal is delivered to the mold cavity, as indicated by the arrow F. A check valve 24 having a valve body 25, which is tensioned in relation to a valve seat 32 counter to the direction of flow by a spring 26, is disposed in the transition between the riser 22 and the filling duct 23.

In the following, the individual phases of the introduction of the molten metal M into the mold cavity F are to be explained.

According to FIG. 1, the piston 13 has reached its upper position, wherein the valve body 20 is located in its closed position (FIG. 2) and prevents an outflow of molten metal from the filling bores 16 into the collection chamber 15. The collection chamber 15 is filled with molten metal M. The piston 13 is then displaced downward together with the valve rod 19, wherein the valve body 20 remains in its closed position. Since the lower region of the piston 13 sits in a sealed manner in the cylinder bore 12, the molten metal located in the collection chamber 15 is squeezed out of the collection chamber 15 and conveyed via the transverse bore 31 and the riser 22 to the check valve 24 which, as a result of the pressure opposing the force of the spring 26, is open. The molten metal M can thus enter into the filling duct 23 and is delivered to the mold cavity (arrow F). Once the piston 13 has reached its lower position, the filling process is terminated and the movement of the piston 13 is reversed, i.e. the piston 13 is moved upward. Initially, the valve body 20 is brought into its open position in that the valve rod 19 is displaced within the axial bore and the valve body 20 is lifted off the end side of the piston 13 (see FIG. 3).

As is shown in FIGS. 2 and 3, the annular space 17 is connected via the inlet duct 18 to the container interior space 29 of the storage container 27 at every axial position of the piston 13, i.e. in the upper position of the piston 13, according to FIG. 2, and in the lower position of the piston 13, according to FIG. 3, as well as in every intermediate position, such that there constantly is molten metal M at the end-side outlet of the filling bores 16.

Prior to or at the same time as adjusting the piston 13 from its lower position, the valve rod 19 having the valve body 20 is adjusted in relation to the piston 13, on account of which the valve body 20 reaches its open position. During retraction of the piston 13 into its upper position, the molten metal M thus flows out of the storage container 27 through the inlet duct 18, the annular space 17, and the filling bores 16 into the collection chamber 15. On account of the displacement of the piston 13, slight negative pressure may potentially be established in the collection chamber 15. Any intake or a return flow of the molten metal M still located in the riser 22 or the filling duct 23 is prevented on account of the check valve 24 closing.

Once the piston 13 has reached its upper position and the collection chamber 15 has been filled with the molten metal M, the valve body 20 is displaced into its closed position in which said valve body 20 interrupts the connection between the filling bores 16 and the collection chamber 15. In this instant, the initial position illustrated in FIG. 1 is reached again, upon which the piston 13 is displaced downward again and squeezes the molten metal M from the collection chamber 15 into the mold cavity (arrow F). While specific embodiments of the invention have been shown and described in detail to illustrate the application of the principles of the invention, it will be understood that the invention may be embodied otherwise without departing from such principles.

The invention claimed is:

1. A conveying device for molten metal in an injection die casting unit, the conveying device comprising:

a storage container for the molten metal;

a valve body;

an adjustable valve rod connected to the valve body;

a piston having an outer wall;

a conveying duct in which the molten metal is deliverable to a mold cavity, wherein the conveying duct comprises a cylinder bore in which the piston is disposed in an axially adjustable manner, and wherein:

a collection chamber for the molten metal, from which the molten metal is introducible through an onward line into the mold cavity as a result of an axial displacement of the piston;

an annular space is formed between the outer wall of the piston and an inner wall of the cylinder bore;

the annular space is connected via at least one filling bore to the collection chamber, wherein the molten metal from the storage container feeds into the at least one filling bore;

an end of the at least one filling bore opens into the collection chamber and is closable by means of the valve body which is connected to the adjustable valve rod; and the valve rod is displaceably disposed in an axial bore of the piston.

2. The conveying device as claimed in claim 1, wherein the collection chamber is configured in the cylinder bore.

3. The conveying device as claimed in claim 1, wherein the at least one filling bore penetrates the piston.

4. The conveying device as claimed in claim 1, wherein the annular space is connected via a plurality of filling bores to the collection chamber.

5. The conveying device as claimed in claim 4, wherein a common valve body is provided for all filling bores.

6. The conveying device as claimed in claim 1, wherein the cross section of the valve body is smaller than the cross section of the cylinder bore.

7. The conveying device as claimed in claim 1, wherein a check valve is disposed in the onward line.

8. A conveying device for molten material in an injection die casting unit, the conveying device comprising:

a storage container for the molten material;

a valve body;

an adjustable valve rod connected to the valve body;

a piston comprising at least one filling bore, a piston axial bore and an outer wall;

a conveying duct for delivering the molten material to a mold cavity, wherein the conveying duct comprises a cylinder bore, at least a portion of the piston being arranged in the cylinder bore such that the at least the portion of the piston is axially adjustable in the cylinder bore, at least a portion of the cylinder bore defining at least a portion of a collection chamber for the molten material, the outer wall of the piston and an inner wall of the cylinder bore defining an annular space, the annular space being in communication with the collection chamber via at least one filling bore when the valve body is located at a spaced location from the piston such that the collection chamber receives the molten material from the storage container, the at least one filling bore being closed when the valve body is in contact with the piston, at least a portion of the valve rod being in the piston axial bore such that the valve rod is movable relative to the piston.

9. The conveying device as claimed in claim 8, wherein the storage container comprises a storage container interior space, the storage container interior space being in communication with at least the at least one filling bore.

10. The conveying device as claimed in claim 8, wherein the housing comprises a conveying duct for delivering the molten material to a mold cavity, wherein the molten material is introducible through an onward line into the mold cavity as a result of an axial displacement of the piston.

11. A conveying device for molten material in an injection die casting unit, the conveying device comprising:

a storage container for molten material;

a valve body;

an adjustable valve rod connected to the valve body;

a piston comprising at least one filling bore, a piston axial bore and an outer wall;

a housing comprising a cylinder bore, the storage container being connected to the housing, at least a portion of the piston being movably arranged in the cylinder bore such that the at least the portion of the piston is axially adjustable in the cylinder bore, at least a portion of the cylinder bore defining at least a portion of a collection chamber, the outer wall of the piston and an inner wall of the housing defining an annular space, the annular space being in communication with the collection chamber via the at least one filling bore when the valve body is located at a spaced location from the piston such that the collection chamber receives molten material from the storage container, the at least one filling bore being closed when the valve body is in contact with the piston, at least a portion of the valve rod being movably arranged in the piston axial bore such that the valve rod is movable relative to the piston.

12. The conveying device as claimed in claim 11, wherein the storage container comprises a storage container interior space, the storage container interior space being in communication with at least the at least one filling bore.

13. The conveying device as claimed in claim 11, wherein the housing comprises a conveying duct for delivering the molten material to a mold cavity, wherein the molten material is introducible through an onward line into the mold cavity as a result of an axial displacement of the piston.

* * * * *